US005615643A

United States Patent [19]

Hill

[11] Patent Number: 5,615,643

[45] Date of Patent: Apr. 1, 1997

[54] FUEL PUMPS FOR INTERNAL COMBUSTION ENGINES

[75] Inventor: Raymond J. Hill, Beldon, Australia

[73] Assignee: Orbital Engine Company (Australia) Pty. Limited, Balcatta, Australia

[21] Appl. No.: 673,560

[22] Filed: Jul. 1, 1996

[51] Int. Cl.[6] ..... F04B 43/06

[52] U.S. Cl. ..... 123/65 B; 123/73 R; 92/100; 417/380

[58] Field of Search ..... 417/380, 382; 92/98 R, 99, 100; 123/73 R, 73 A, 65 B

[56] References Cited

U.S. PATENT DOCUMENTS

| | | | |
|---|---|---|---|
| 3,222,999 | 12/1965 | Hager | 92/99 |
| 3,387,566 | 6/1968 | Temple | 417/403 |
| 3,467,021 | 9/1969 | Green | 417/399 |
| 3,700,359 | 10/1972 | Vanderjagt | 417/404 |
| 4,049,366 | 9/1977 | Becker | 92/99 |
| 4,093,403 | 6/1978 | Schrimpf et al. | 417/395 |
| 4,193,264 | 3/1980 | Takahashi et al. | 60/397 |
| 4,317,432 | 3/1982 | Noguchi et al. | 123/73 A |
| 4,473,340 | 9/1984 | Walsworth | 417/380 |
| 4,502,848 | 3/1985 | Robertson et al. | 417/380 |
| 4,666,378 | 5/1987 | Ogawa | 92/100 |
| 5,000,134 | 3/1991 | Fujimoto et al. | 123/73 A |
| 5,024,190 | 6/1991 | Kameyama | 123/73 AD |
| 5,259,352 | 11/1993 | Gerhardy et al. | 417/380 |

*Primary Examiner*—David A. Okonsky
*Attorney, Agent, or Firm*—Nikaido, Marmelstein Murray & Oram LLP

[57] ABSTRACT

A pump comprising a pumping chamber (3) for pumping a liquid; at least part of the pumping chamber (3) being formed by a pumping means (6) having a pumping area (A2); an actuation chamber (2) in communication with a source of pressurised fluid, at least part of the, actuation chamber (2) being formed by an actuation means (5) having an actuation area (A1); a connection means (7) connecting the actuation means and the pumping means, so that, at least during those times that liquid is required to be pumped by the pump, variations of the pressure in the actuation chamber effect movement of the actuation means which in-turn effects movement of the pumping means to enable supply of liquid to the pumping chamber and delivery of liquid therefrom; wherein the pressure within the pumping chamber is greater than the pressure within the actuation chamber.

19 Claims, 1 Drawing Sheet

FUEL PUMPS FOR INTERNAL COMBUSTION ENGINES

Figure 1:
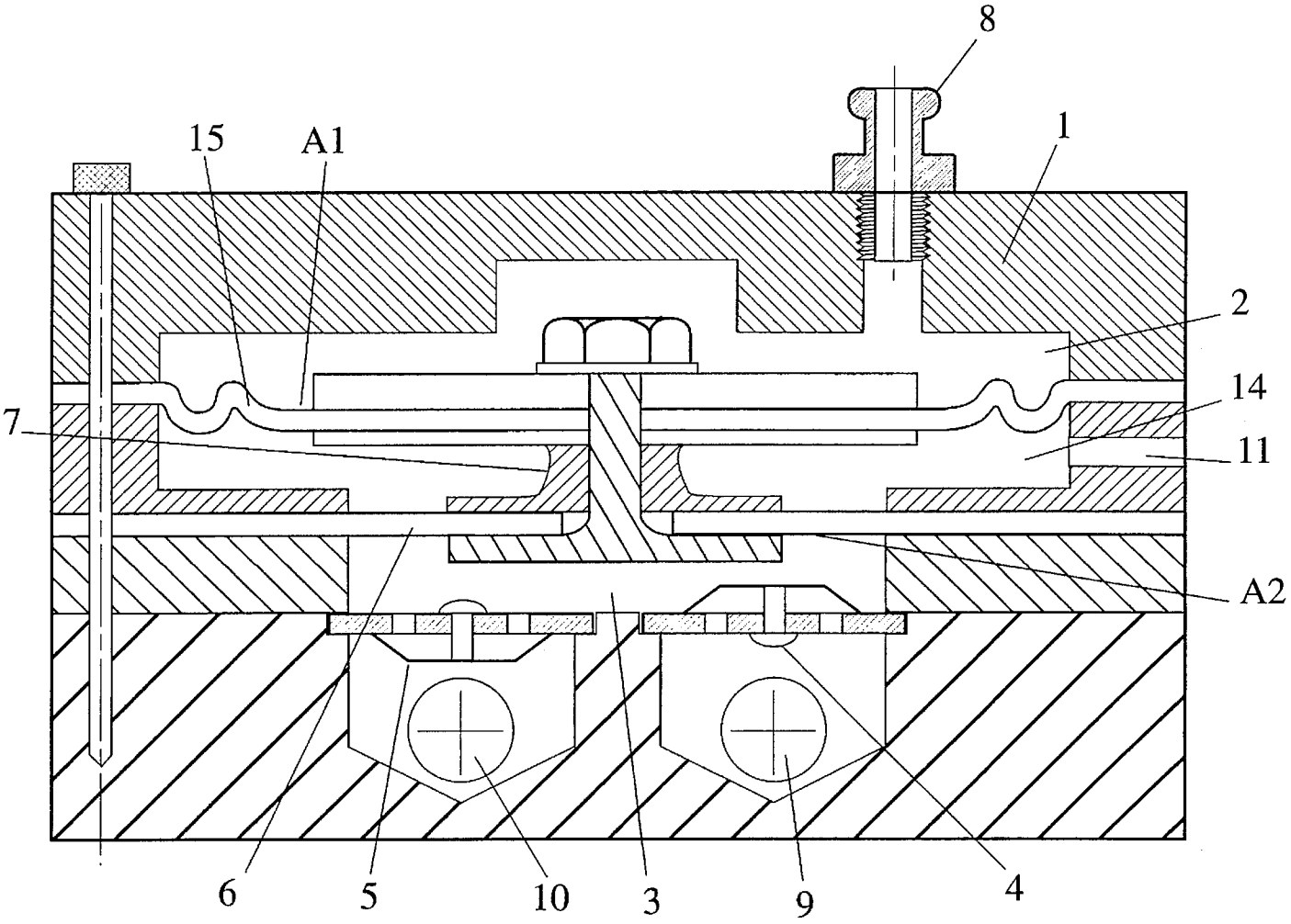

This invention relates to pumps and, in particular, to pumps suitable for fuel pumping applications.

Internal combustion engines operating on the basis of combustion of fuel and air are well known. In certain engines, the fuelling requirement of the engine is set in relation to a predetermined air flow set by the position of a throttle valve in the induction manifold of the engine. A proportion of these engines together with other forms of engines may be fuel injected engines wherein metered quantities of fuel are delivered into a combustion chamber of the engine, optimally entrained in the required quantity of gas to attain a desired air/fuel ratio for initiation of combustion. The achievement of this ratio is important because if it is too high, the combustion mixture will be too lean to enable initiation of combustion. If it is too low, the combustion mixture will be enriched in fuel and the engine will typically be subject to misfire. Generally, failure to achieve accurate control over this air/fuel ratio gives rise to excessive exhaust emissions.

Therefore, it is desirable to deliver fuel to a combustion chamber of an internal combustion engine in quantities that are as accurately metered as possible. In systems that use a compressed gas to deliver metered quantities of fuel to an engine, it is also important to control the gas pressure (more particularly the fuel/gas pressure difference) and injection timing to achieve desirable characteristics (for example, fuel atomisation and/or fuel distribution) of injection. To this end, an air or gas compressor is typically provided with characteristics carefully chosen to achieve the above required objectives.

Generally, fuel pumps used in conventional internal combustion engines are electric fuel pumps which enable the required amount of fuel to be delivered to the engine in response to driver demand. Such pumps are normally situated in a fuel tank and are sized to meet the maximum fuel demands of the engine with an additional allowance for some fuel recirculation back to the fuel tank. In the case that the engine is being operated at low power, there will be significant amounts of excess fuel returned to the fuel tank and therefore significant energy consumption will occur due to the fuel pump without need. This is particularly true in fuel injected engines since there is generally a requirement that the fuel pressure be reasonably high, typically of the order of 4 to 7 bar. As a result of the electric fuel pump consuming reasonably high amounts of energy, even when the engine is operating in a low power mode, there is normally a significant heat input to the fuel from the pump resulting in fuel vapour generation.

In order to avoid the wastage of energy by fuel pumps, systems have been developed in an attempt to better match the fuel supply of the fuel pump with the fuel demands of the engine. Usually, this requires that the operation of the fuel pump be under the control of a control unit, generally an electronic control unit (ECU), wherein the pump is effectively switched on or off according to engine fuel demand. An accumulation system is normally used to maintain a supply of fuel at the required pressure to the engine whilst the pump is switched off. As the fuel demands for an engine are likely to vary during use, the repeated on-and-off switching of the fuel pump may lead to accelerated wear thereof. Although such "smart" pumps do provide lower energy consumption than previous systems, they are typically more complicated and more expensive and normally still use a return line to the fuel tank to ensure that fuel vapour problems do not occur at the injection system.

Further, the operation of electric fuel pumps, whether controlled according to fuel demand or otherwise, creates a requirement for electrical power that may be disadvantageous in certain applications, for example, small engine applications such as motor scooter, outboard engines and the like.

Another disadvantage of electric fuel pumps is the relative expense of the pump and associated power supply and control components. This may be of special importance in small engine applications mentioned above and/or in countries where savings in cost to engine producers and end users are critical as in the case, for example, of developing countries.

It is also important in some applications, such as motor scooters, that engine weight and space is kept to a minimum. The use of an electric pump in such applications may therefore be disadvantageous.

It is therefore the object of the present invention to provide pumps, especially for liquids, which overcome at least one of the disadvantages of prior art systems.

With this object in view, the present invention provides in one aspect a pump for an internal combustion engine including a pumping chamber for pumping a liquid, at least part of the pumping chamber being formed by a pumping means having a pumping area, an actuation chamber in communication with a source of pressurised fluid, at least part of the actuation chamber being formed by an actuation means having an actuation area, the actuation area being different than the pumping area, a connection means connecting the actuation means and the pumping means, so that, at least during periods when liquid is required to be pumped by the pump, variations of the pressure in the actuation chamber effect movement of the actuation means which in-turn effects movement of the pumping means to enable supply of liquid to the pumping chamber and delivery of liquid therefrom, wherein the pressurised fluid source is provided by the engine, and a relatively constant pressure differential is provided between the pumped liquid and the pressurised fluid.

Preferably the pump provides pressure amplification wherein the pressure within the pumping chamber or the pressure generated within the pumping chamber may be greater than the pressure within the actuation chamber. That is, the maximum pressure imposed in said pumping chamber is greater than the maximum pressure delivered by said source of pressurised fluid. To this end, the actuation area is preferably greater than the pumping area. In this regard, the relative working areas of the pumping means and the actuation means may be calculated to achieve the desired maximum pressure in the pumping chamber.

Preferably, the pump pumps fuel for a two fluid injection system of the internal combustion engine. The internal combustion engine is preferably a two stroke, crankcase scavenged engine.

Preferably the connection means passes through a connection chamber. The connection chamber may typically be vented to the atmosphere, or in the case wherein the pump is used to pump fuel for use in the internal combustion engine, it is advantageously vented to an area which reduces any risks associated with fuel leakage, such as, to the main air intake to the engine or directly to the crankcase of the engine in the case of a crankcase scavenged two stroke engine. In this way, any fuel leakage past the pumping means will be returned to the engine and thus avoid any undesirable consequences.

Preferably the connection means is in the form of a substantially rigid member acting at either end to the actuating means and the pumping means respectively.

Preferably the pressurised fluid is a compressible fluid such as a gas.

The liquid pumped by the pump may be in the form of fuel for use in an internal combustion engine. Whilst the invention is particularly useful for the supply of fuel for use in the internal combustion engine, particularly by a fuel injection system, it is contemplated that other liquids may also be advantageously pumped, such as engine lubricants.

Advantageously, in two stroke engines operating on the crankcase scavenged principle, the actuation chamber is connected directly to the crankcase of the engine. In such an engine, in order to attain the desired fuel pressure level required, there is a need to "amplify" the pressure occurring within the engine crankcase. This may be achieved by having the area of the pumping means smaller than the area of the actuating means.

It has been recognised that engines which utilise a dual fluid fuel injection system to inject a metered quantity of fuel with the assistance of a compressed gas offer certain advantages especially when used to inject fuel directly into the combustion chamber of a two stroke engine.

In such a system, in addition to the need to provide a source of pressurised fuel, there may also be the need for a source of pressurised gas and pressure regulators to control the differential pressure between the fuel and the gas to enable accurate fuel metering to occur.

Therefore, in a preferred embodiment, the source of fluid for the pump is an air compressor used to provide a pressurised gas to a fuel injection system for injecting metered quantities of fuel to an engine. In this way, a desirable relatively constant pressure differential between the fuel and the pressurised gas can be achieved and maintained without a regulator and notwithstanding changes in compressor performance. Such a pressure differential will be maintained despite changes in the operation of the compressor which may cause a change in the pressure of the gas. This is particularly advantageous as it is known that the fuel/gas pressure differential is an important control parameter in such fuel/gas injection systems and particularly in those systems where fuel metering is accomplished by the "pressure-time" principle (as opposed to, for example, positive displacement metering which is not so sensitive to changes in the fuel/gas pressure differential).

Preferably one or both of the pumping means or the actuation means are in the form of a diaphragm.

The pump preferably operates at the engine operating frequency. Due to the typically relatively small amounts of fuel required by the engine, even at relatively high loads, over each engine cycle, only relatively small motions of the actuation means and the pumping means are required. Therefore, this makes the use of diaphragms an ideal low cost option. The relatively small motions required of the diaphragms result in only relatively low stresses thereon.

The use of diaphragms is particularly advantageous as they are relatively inexpensive, provide good sealing for fluids, have low friction losses, and have relatively fast dynamic response. This last attribute is particularly advantageous in the case of a fuel pump for an internal combustion engine especially in the case that the pump is pumping only that amount of fuel required by the engine at that point in time (ie: a "demand" type pump) as the quantities of fuel can be relatively small and engine speeds can be relatively high. Further, the use of diaphragms are also advantageous in regard to production as unlike units using pistons and sliding seals, there are no tight tolerances or special surface finishes required. Hence, the machining cost of a total unit may be significantly lower as virtually no machining may be necessary on the unit.

In a preferred embodiment the liquid to be pumped is delivered in discretely metered quantities downstream of the pump.

In another form of the invention, the pump can be used as a metering type pump, wherein the actuation chamber is connected to the pressurised fluid source via a throttle means. By using a throttle means the pressure within the actuation chamber may be controlled, thus controlling the displacement or stroke of the actuation means, which via the connection means, will control the displacement or stroke of the pumping means.

Further details of the ways in which the invention may be adapted to operate as a fuel metering pump will be obvious upon reference to the Applicant's co-pending Australian patent application No. PN3915 filed on May 30, 1995, the contents of which are incorporated herein by reference.

In the case of a multicylinder crankcase scavenged two stroke engine as discussed above, it may be advantageous to connect the crankcase of one cylinder to the actuation chamber, and the crankcase of another out-of-phase cylinder to the connection chamber. This will lead to a greater pressure differential across the actuation means and greater pressure amplification between the actuation chamber and the pumping chamber. It will also lead to greater forces acting in the pump in the refilling stroke. The degree that the other cylinder may be out of phase can vary between 90° and 270° but 180° may be found particularly advantageous in this respect.

Inlet and outlet valves may be provided for the pumping chamber. Advantageous characteristics of the inlet and outlet valves may include biasing of the valves such that the fuel inlet valve tends to open in response to pressure in the pumping chamber falling below a certain level. Equally, the outlet valve may be biased to open when the pressure in the actuation chamber exceeds a certain level. Suitable biasing means include springs and like devices. The inlet and outlet valves may be of the non-return type.

The actuation or pumping means may likewise be biased by springs or like devices such that the pumping chamber remains in a filling or suction condition.

In the case of an engine used to power a vehicle/motor scooter etc, there is often changing fuel requirements depending on operator demand. This may vary from maximum fuelling rates during maximum power operation, to zero fuelling rate during "over-run cut" which can occur when a vehicle is coasting down a hill. In the later case, the fuel pump is not required to delivery any fuel to the engine.

Therefore, in a preferred embodiment, the pumping means does not pump at those times when there is not a requirement for liquid or fuel to be pumped, even when the actuation chamber is exposed to pressure fluctuations from the pressurised fluid source.

In the example given, even though the actuation chamber will be exposed to crankcase pressure fluctuations, no pumping will occur (and therefore no work will be done by the pump) since the pumping chamber is prevented from discharging any fuel from its outlet. Accordingly, the fuel delivered or pumped by the pump is better matched to the overall fuel demands of the engine. This is achieved in a desirably low cost fashion which results in minimal to no wastage of energy occurring.

In a preferred embodiment of the invention, especially when used as a fuel pump for an internal combustion engine, the pump may be located in a fuel tank with the fuel delivery line to the engine being disposed within the line connecting the fluid pressure source (such as the engine crankcase in the case of a two stroke engine) to the pump. As the pumping of the fuel is reliant on pressure from the fluid pressure source being available at the actuation chamber, any breakage or leakage of the line connecting the fluid pressure source to the pump will disable the pump and prevent fuel from being pumped. The fuel line may be located concentrically within the pressurised fluid supply line, thus also providing extra protection for the fuel line. This arrangement is particularly useful in marine applications where the existence of a pressurised fuel line (in this case between the fuel tank and the engine) may cause safety concerns. The present arrangement alleviates such concerns since if the fuel line breaks, the supply of pressurised gas to actuate the pump will also be lost.

Although the present invention is especially suitable for use in engines of the direct injected type, the pump may be used in carburetted engines.

The pump may be sold as a ready-to-use unit or as a kit of parts. As the diaphragms may wear over time it may be appropriate to sell these separately or in the form of assemblies of first and second diaphragms.

The pump as described above is adapted to generate pressures comparable with those developed by electric fuel metering pumps, but in a manner that is less expensive. It is also to be understood that, unlike electric pumps, there is no motor which may cause undesirable heating and vaporisation of fuel. Accordingly, specialised means for cooling fuel and removing vapour may be avoided by use of the present invention.

The invention will be better understood from the description of a preferred embodiment thereof which is made with reference to the accompanying drawing wherein FIG. 1 is a schematic cross-sectional view of a fuel pump according to the present invention.

The fuel pump according to the present invention includes a housing 1, a pumping chamber 3 and an actuation chamber 2 provided within the housing 1. The pumping chamber 3 is defined by a pumping means in the form of a first diaphragm 6. The pumping chamber 3 is also provided with an inlet valve 4 and an outlet valve 5. The pumping chamber 3 is connected to a fuel inlet passage 9 via the inlet valve 4 and is also connected to a fuel outlet passage 10 via the outlet valve 5. Fuel is pumped through this pumping chamber 3.

The actuation chamber 2 is defined by an actuation means in the form of a second diaphragm 15. Connection means 7 mechanically connects the second diaphragm 15 with the first diaphragm 6. Therefore, any movement of the second diaphragm 15 will be directly transmitted to the first diaphragm 6.

The actuation chamber 2 is in communication with the crankcase of an engine (not shown) through a connection spigot 8 supported on the housing 1. The actuation chamber 2 is therefore subjected to the fluctuating gas pressure within the crankcase.

A connection chamber 14 is provided between the first diaphragm 6 and the second diaphragm 15. This connection chamber 14 is vented to the atmosphere through vent hole 11. The side of the second diaphragm 15 facing the actuation chamber 2 is therefore subjected to the crankcase pressure which will typically cycle between sub-atmospheric and above atmospheric pressures during each engine cycle. The opposing side of the second diaphragm 15 facing the connection chamber 14 will however be subjected to at least substantially atmospheric pressure at all times. Therefore, the second diaphragm 15 will be displaced away from and towards the pumping chamber 3 during each engine cycle. Because the first diaphragm 6 is directly connected to the second diaphragm 15, the first diaphragm 6 will also cycle in direct response to the cycling of the displacement of the second diaphragm 15.

Therefore, when the crankcase pressure is below atmospheric, the second diaphragm 15 will move away from the pumping chamber 3 and will similarly move the first diaphragm 6 which will produce a vacuum in the pumping chamber 3 resulting in the opening of the inlet valve 4 so that fuel can flow into the pumping chamber 3 while the outlet valve 5 remains closed. Correspondingly, when the crankcase pressure is above atmospheric, the second diaphragm 15 will be displaced towards the pumping chamber 3 causing the first diaphragm 6 to also move in the same direction resulting in the closing of the inlet valve 4 and the opening of the outlet valve 5 to thereby deliver fuel to the engine and/or a fuel injection system thereof.

The actuation area A1 of the second diaphragm 15 is larger than the pumping area A2 of the first diaphragm 6. Pressure changes within the actuation chamber 2 are thereby effectively amplified to provide relatively higher pressure changes within the pumping chamber 3. The required fuel pressure can therefore be provided from the fuel pump.

The present invention eliminates the need for an electric fuel pump because the fuel pump of the present invention is actuated by means of the second diaphragm 15 moving in response to cyclic fluctuations in the pressure of the gas within the engine crankcase, this movement of the second diaphragm 15 being used to drive the fuel pump.

It is to be appreciated that alternative sources of pressurised gas are also envisaged. For example, in dual fluid injection systems utilising compressed air from an air compressor, the air compressor can also provide the source for pressurised gas for the fuel pump. Regardless of the pressurised gas source, the present invention can provide a relatively constant pressure differential between the pumped fuel and the source of pressurised gas.

The claims defining the invention are as follows:

1. A pump for an internal combustion engine including a pumping chamber for pumping a liquid, at least part of the pumping chamber being formed by a pumping means having a pumping area, an actuation chamber in communication with a source of pressurised fluid, at least part of the actuation chamber being formed by an actuation means having an actuation area, the actuation area being different than the pumping area, a connection means connecting the actuation means and the pumping means, so that, at least during periods when liquid is required to be pumped by the pump, variations of the pressure in the actuation chamber effect movement of the actuation means which in-turn effects movement of the pumping means to enable supply of liquid to the pumping chamber and delivery of liquid therefrom, wherein the pressurised fluid source is provided by the engine, and a relatively constant pressure differential is provided between the pumped liquid and the pressurised fluid.

2. A pump according to claim 1 wherein the actuation area is greater than the pumping area so that the pump provides pressure amplification whereby the pressure within the pumping chamber or the pressure generated within the pumping chamber is greater than the pressure within the actuation chamber.

3. A pump according to claim 1 wherein the pump pumps fuel for a two fluid injection system of the internal combustion engine.

4. A pump according to claim 1 wherein the engine is of the two stroke crankcase scavenged type.

5. A pump according to claim 1 further including a connection chamber through which the connection means passes.

6. A pump according to claim 5 wherein the connection chamber is vented to atmosphere.

7. A pump according to claim 5 wherein the connection chamber is vented to the air intake of the engine.

8. A pump according to claim 5 wherein the engine is of the two stroke crankcase scavenged type and the connection chamber is vented to the crankcase of the engine.

9. A pump according to claim 5 wherein the connection means is in the form of a substantially rigid member interconnecting the actuating means and the pumping means.

10. A pump according to claim 1 wherein the pressurised fluid is a compressible fluid.

11. A pump according to claim 1, wherein the engine is of the two stroke crankcase scavenged type and wherein the source of pressurised fluid is in the crankcase.

12. A pump according to claim 11 wherein the engine includes a plurality of cylinders, the crankcase of one cylinder being connected to the actuation chamber, the crankcase of another, out-of-phase cylinder, being connected to the connection chamber.

13. A pump according to claim 1 wherein the source of pressurised fluid is an air compressor for providing a pressurised gas to a fuel injection system of the engine.

14. A pump according to claim 1 wherein at least one of the pumping means and the actuation means is in the form of a diaphragm.

15. A pump according to claim 1 wherein the pumped liquid is delivered downstream of the pump in discretely metered quantities.

16. A pump according to claim 1 including means to prevent pumping under certain engine operating conditions.

17. A pump according to claim 1 including throttling means provided between the actuation chamber and the pressurised fluid source to thereby control the pressure within the actuation chamber.

18. A pump according to claim 1 when used as a fuel pump for an internal combustion engine, wherein the pump is located in a fuel tank with a fuel delivery line to the engine being disposed within a supply line connecting the source of the pressurised fluid to the pump.

19. A pump according to claim 18 wherein the fuel delivery line is located concentrically within the supply line.

* * * * *